US008807102B2

(12) United States Patent
Arai et al.

(10) Patent No.: US 8,807,102 B2
(45) Date of Patent: Aug. 19, 2014

(54) VARIABLE VALVE OPERATING DEVICE FOR INTERNAL COMBUSTION ENGINE

(75) Inventors: Tetsuya Arai, Wako (JP); Takao Tamechika, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 133 days.

(21) Appl. No.: 13/393,861

(22) PCT Filed: Sep. 14, 2009

(86) PCT No.: PCT/JP2009/066007
§ 371 (c)(1),
(2), (4) Date: Mar. 2, 2012

(87) PCT Pub. No.: WO2011/030457
PCT Pub. Date: Mar. 17, 2011

(65) Prior Publication Data

US 2012/0152194 A1 Jun. 21, 2012

(51) Int. Cl.
*F01L 1/34* (2006.01)
*F01L 1/14* (2006.01)
*F01L 13/00* (2006.01)

(52) U.S. Cl.
CPC ..... *F01L 13/0036* (2013.01); *F01L 1/34* (2013.01); *F01L 1/146* (2013.01); *F01L 2820/035* (2013.01)
USPC ..... 123/90.16

(58) Field of Classification Search
USPC ..... 123/90.15–90.17, 90.31, 90.6
See application file for complete search history.

(56) References Cited

U.S. PATENT DOCUMENTS 1,980,379 A 11/1934 Burnett
4,589,387 A * 5/1986 Miura et al. ..... 123/198 F (Continued)

FOREIGN PATENT DOCUMENTS

DE 195 26 888 A1 1/1997
DE 10 2005 039 751 A1 3/2007

(Continued)

OTHER PUBLICATIONS

Supplementary Europan Search Report dated Mar. 7, 2013, issued in corresponding European Patent Application No. 09849235 (2 pages).

(Continued)

*Primary Examiner* — Thomas Denion
*Assistant Examiner* — Steven D Shipe
(74) *Attorney, Agent, or Firm* — Westerman, Hattori, Daniels & Adrian, LLP

(57) ABSTRACT

In a variable valve operating device for an internal combustion engine, which is capable of changing operation characteristics of an engine valve in accordance with a change in rotation speed of a camshaft, a high-speed cam (60) including a base circle portion which has the same radius as that of a base circle portion of a low-speed cam (59) and also including a high-level portion which has a protruding amount larger than that of a high-level portion of the low-speed cam (59) is supported on a camshaft (43A) having the low-speed cam (59) fixed thereto such that the high-speed cam (60) is rotatable relative to the camshaft (43A), at a position adjacent to the low-speed cam (59); a cam follower member (46) is supported by an engine main body (11) to be operable in a manner following one of the low-speed cam (59) and the high-speed cam (60); and a centrifugal clutch (61A) configured to connect the high-speed cam (60) to the camshaft (43A) while synchronizing the phase of the high-speed cam (60) with that of the low-speed cam (59) when the rotation speed of the camshaft (43A) reaches or exceeds a predetermined rotation speed is provided between the camshaft (43A) and the high-speed cam (60). Accordingly, it is possible to change operation characteristics of an engine valve with a simple and compact structure.

1 Claim, 6 Drawing Sheets

(56) References Cited

U.S. PATENT DOCUMENTS

| | | | | |
|---|---|---|---|---|
| 5,239,885 | A * | 8/1993 | Voigt | 74/567 |
| 5,345,898 | A * | 9/1994 | Krebs | 123/90.17 |
| 5,609,127 | A * | 3/1997 | Noplis | 123/90.17 |
| 2005/0034694 | A1* | 2/2005 | Williams | 123/90.17 |
| 2009/0272348 | A1* | 11/2009 | Yamamoto et al. | 123/90.17 |
| 2009/0301419 | A1* | 12/2009 | Hiraga | 123/90.31 |
| 2011/0168114 | A1* | 7/2011 | Kobayashi et al. | 123/90.17 |

FOREIGN PATENT DOCUMENTS

| | | | |
|---|---|---|---|
| EP | 0 582 846 | A1 | 2/1994 |
| EP | 1956197 | A1 | 8/2008 |
| JP | 60-228712 | A | 11/1985 |
| JP | 61-212615 | A | 9/1986 |
| JP | 62-131907 | A | 6/1987 |
| JP | 1-138309 | A | 5/1989 |
| JP | 2-135608 | U | 11/1990 |
| JP | 09-256827 | A | 9/1997 |
| JP | 2002-081303 | A | 3/2002 |
| WO | 2007/060865 | A1 | 5/2007 |

OTHER PUBLICATIONS

Japanese Office Action dated Mar. 7, 2012, issued in corresponding Japanese Patent Application No. 2008-206287.

International Search Report of PCT/JP2009/066007, dated Dec. 22, 2009.

* cited by examiner

VARIABLE VALVE OPERATING DEVICE FOR INTERNAL COMBUSTION ENGINE

TECHNICAL FIELD

The present invention relates to a variable valve operating device for an internal combustion engine, including: an engine valve which is disposed in an engine main body to be operable to be opened and closed and which is biased to a valve-closing side; a camshaft rotatably supported by the engine main body; and a cam follower member which follows a cam rotating together with the camshaft and operates to transmit a valve-opening force to the engine valve side, the variable valve operating device being capable of changing an operation characteristic of the engine valve in accordance with a change in rotation speed of the camshaft.

BACKGROUND ART

The following variable valve operating device is already known from Patent Document 1. The variable valve operating device is provided with a cam tube in which two cam portions with different cam profiles are disposed adjacent to each other in an axial direction of a camshaft. The cam tube is driven in the axial direction by an actuator between a position where one of the cam portions is in contact with a cam follower member and a position where the other one of the cam portions is in contact with the cam follower member, thereby changing the operation characteristics of an engine valve.

Patent Document 1: Japanese Patent Application Laid-open No. 61-212615

DISCLOSURE OF INVENTION

Problems to be Solved by the Invention

In the structure disclosed in the above-described Patent Document 1, the actuator exists at a position spaced away from the camshaft, and the cam is driven in the axial direction by a lever driven to turn by the actuator. Thus, not only the structure is complicated, but also a space for disposing the actuator is required, leading to an increase in the size of the valve operating device.

The present invention is made in view of the circumstances described above, and an object thereof is to provide a variable valve operating device for an internal combustion engine which is capable of changing operation characteristics of an engine valve with a simple and compact structure.

Means for Solving the Problems

In order to attain the above object, according to a first aspect of the present invention, there is provided a variable valve operating device for an internal combustion engine, including: an engine valve which is disposed in an engine main body to be operable to be opened and closed and which is biased to a valve-closing side; a camshaft rotatably supported by the engine main body; and a cam follower member which follows a cam rotating together with the camshaft and operates to transmit a valve-opening force to the engine valve side, the variable valve operating device being capable of changing an operation characteristic of the engine valve in accordance with a change in rotation speed of the camshaft, characterized in that a high-speed cam is supported on the camshaft having a low-speed cam fixed thereto such that the high-speed cam is rotatable relative to the camshaft, at a position adjacent to the low-speed cam, the low-speed cam including an arc-shaped base circle portion which is centered on an axis of the camshaft and a high-level portion which protrudes outward from the base circle portion, the high-speed cam including a base circle portion which has the same radius as that of the base circle portion of the low-speed cam and also including a high-level portion which has a protruding amount larger than that of the high-level portion of the low-speed cam, the cam follower member contactable with the low-speed cam and the high-speed cam is supported by the engine main body to be operable in a manner following one of the low-speed cam and the high-speed cam, and a centrifugal clutch is provided coaxially with the camshaft, between the camshaft and the high-speed cam, the centrifugal clutch configured to connect the high-speed cam to the camshaft while synchronizing the phase of the high-speed cam with that of the low-speed cam when the rotation speed of the camshaft reaches or exceeds a predetermined rotation speed.

Here, an intake valve 37 of a first embodiment and an intake valve 37 and an exhaust valve 38 of a second embodiment correspond to the engine valve of the present invention; an intake-side tappet 46 of the first embodiment and an intake-side tappet 46 and an exhaust-side tappet 47 of the second embodiment correspond to the cam follower member of the present invention; an intake-side low-speed cam 59 of the first embodiment and an intake-side low-speed cam 59 and an exhaust-side low-speed cam 75 of the second embodiment correspond to the low-speed cam of the present invention; and an intake-side high-speed cam 60 of the first embodiment and an intake-side high-speed cam 60 and an exhaust-side high-speed cam 76 of the second embodiment correspond to the high-speed cam of the present invention.

Effects of the Invention

With the configuration of the present invention described above, when the rotation speed of the camshaft is below the predetermined rotation speed, the centrifugal clutch is in a power transmission block state. In this state, the low-speed cam rotates together with the camshaft while the high-speed cam rotates in an idling manner about the axis of the camshaft. Thus, the engine valve is operated to be opened and closed with operation characteristics according to a cam profile of the low-speed cam. Meanwhile, when the rotation speed of the camshaft reaches or exceeds the predetermined rotation speed, the centrifugal clutch connects the high-speed cam to the camshaft while synchronizing the phase of the high-speed cam with that of the low-speed cam. Thus, the low-speed cam and the high-speed cam rotate in the same phase. Since the high-level portion of the high-speed cam has a larger protruding amount than the high-level portion of the low-speed cam, the cam follower member does not come into contact with the high-level portion of the low-speed cam and operates in a manner following the high-level portion of the high-speed cam. Thus, the engine valve is operated to be opened and closed with operation characteristics according to a cam profile of the high-speed cam. Moreover, the centrifugal clutch for switching the operation characteristics of the engine valve is provided coaxially with the camshaft between the camshaft and the high-speed cam. Thus, the operation characteristics of the engine valve can be changed with a simple and compact structure.

EXPLANATION OF REFERENCE NUMERALS AND SYMBOLS

Figure 1:
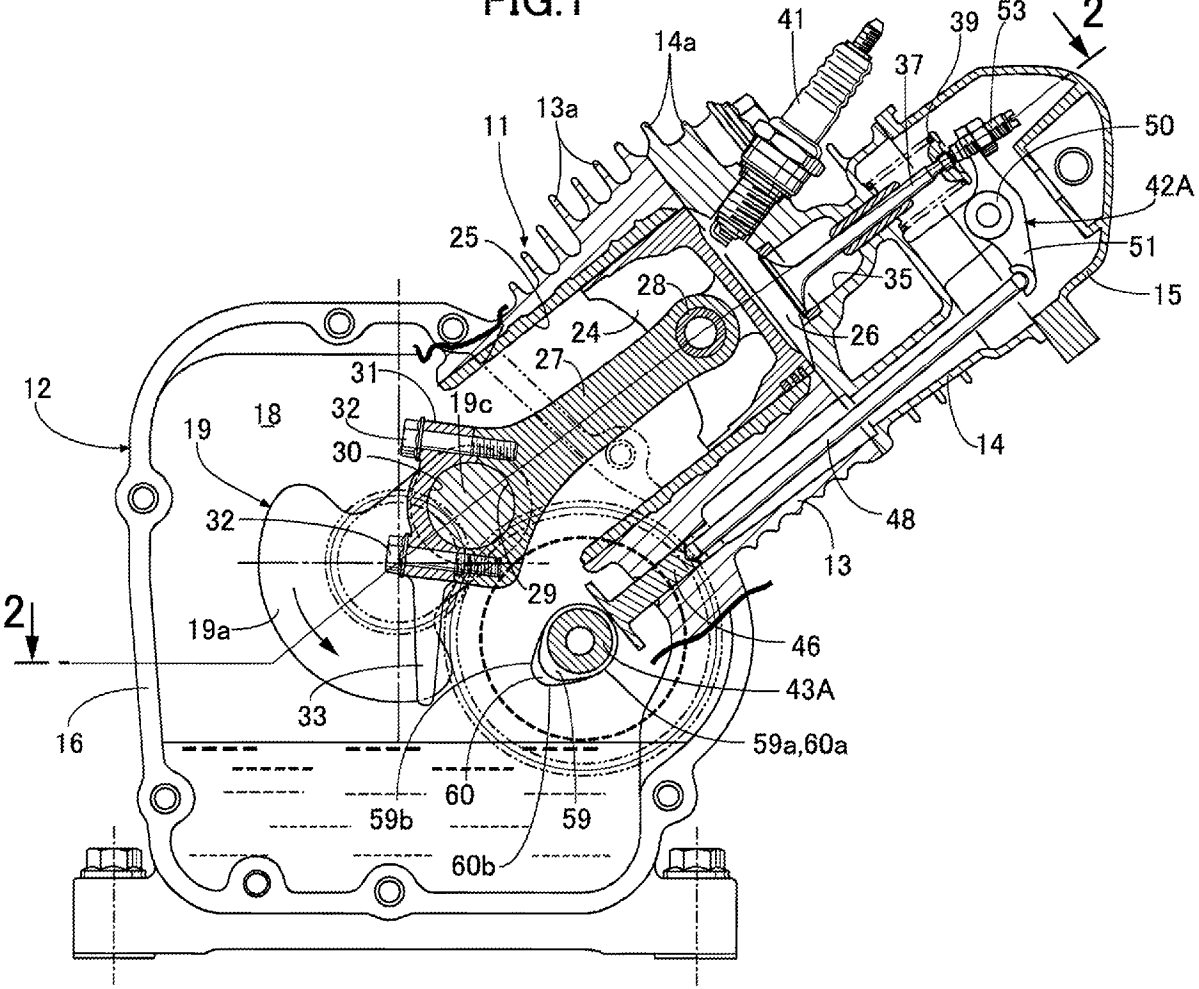
FIG. 1 is a longitudinal cross-sectional side view of an internal combustion engine of a first embodiment, and is a sectional view taken along a line 1-1 in FIG. 2. (First embodiment)

11 . . . engine main body
37 . . . intake valve being engine valve
38 . . . exhaust valve being engine valve
43A, 43B . . . camshaft
46 . . . intake-side tappet being cam follower member
47 . . . exhaust-side tappet being cam follower member
59 . . . intake-side low-speed cam
59*a*, 60*a* . . . base circle portion
59*b*, 60*b* . . . high-level portion
60 . . . intake-side high-speed cam
61A, 61B . . . centrifugal clutch
75 . . . exhaust-side low-speed cam
76 . . . exhaust-side high-speed cam

BEST MODES FOR CARRYING OUT THE INVENTION

Embodiments of the present invention are described below with reference to the attached drawings.

First Embodiment

A first embodiment of the present invention is described with reference to FIGS. 1 to 5. At first, referring to FIGS. 1 and 2, an internal combustion engine herein has an air-cooled single-cylinder configuration to be used for a work machine, etc. for example. An engine main body 11 of the internal combustion engine includes a crank case 12, a cylinder block 13 protruding obliquely upward from one side surface of the crank case 12, a cylinder head 14 joined to a head portion of the cylinder block 13, and a head cover 15 connected to the cylinder head 14. Many air-cooling fins 13*a* . . . , 14*a* . . . are provided on outer surfaces of the cylinder block 13 and the cylinder head 14.

The crank case 12 is formed of a case main body 16 which is formed integrally with the cylinder block 13 by casting and whose one side is opened and of a side cover 17 which is fastened to an open end of the case main body 16. A crank chamber 18 accumulating oil is formed inside the crank case 12. The crank case 12 rotatably supports a crank shaft 19 integrally including a pair of counter weights 19*a*, 19*b* and a crank pin 19*c* connecting both of the counter weights 19*a*, 19*b* to each other. Opposite end portions of the crank shaft 19 rotatably penetrate the case main body 16 and the side cover 17 in the crank case 12, respectively, and protrude outward. A ball bearing 20 and an annular sealing member 21 disposed outward of the ball bearing 20 are interposed between the crank shaft 19 and the case main body 16. A ball bearing 22 and an annular sealing member 23 disposed outward of the ball bearing 22 are interposed between the crank shaft 19 and the side cover 17.

A cylinder bore 25 to which a piston 24 is slidably fitted is formed in the cylinder block 13. A combustion chamber 26 which a top portion of the piston 24 faces is formed between the cylinder block 13 and the cylinder head 14. One end of a connecting rod 27 is connected to the piston 24 via a piston pin 28, and the other end of the connecting rod 27 is connected to the crank pin 19*c* of the crank shaft 19. Specifically, a semi-circular recessed portion 29 to which a substantial half of the circumference of the crank pin 19*c* is to be fitted is provided in the other end of the connecting rod 27, and a crank cap 31 having a semi-circular recessed portion 30 to which a remaining substantial half of the circumference of the crank pin 19*c* is to be fitted is fastened to the other end of the connecting rode 27 with a pair of bolts 32 . . . .

An oil dipper 33 which throws up oil in the crank chamber 18 in accordance with the rotation of the crank shaft 19 is integrally provided to the crank cap 31 in a protruding manner. The oil dipper 33 is housed in the crank chamber 18.

Moreover, an intake port 35 and an exhaust port 36 communicable with the combustion chamber 26 are formed in the cylinder head 14. In addition, an intake valve 37 as an engine valve opening and closing the communication between the intake port 35 and the combustion chamber 26 as well as an exhaust valve 38 opening and closing the communication between the exhaust port 36 and the combustion chamber 26 are disposed in the cylinder head 14 to be capable of performing opening and closing operations. The intake valve 37 is biased in a valve-closing direction by a valve spring 39, and the exhaust valve 38 is biased in a valve-opening direction by an unillustrated valve spring. Furthermore, a spark plug 41 whose front end portion faces the combustion chamber 26 is attached to the cylinder head 14.

A valve operating device 42A which drives the intake valve 37 and the exhaust valve 38 to open and close includes a camshaft 43A which is rotatably supported by the crank case 12, an intake-side tappet 46 which is supported by the case main body 16 of the crank case 12 and the cylinder block 13 to slide in an up-down direction in accordance with the rotation of the camshaft 43A, an exhaust-side tappet 47 which is supported by the case main body 16 and the cylinder block 13 to slide in the up-down direction in accordance with the rotation of the camshaft 43A, an intake-side pushrod 48 which extends in the up-down direction and whose lower end portion is continuous with an upper end portion of the intake-side tappet 46, an exhaust-side pushrod (not illustrated) which extends in the up-down direction and whose lower end portion is continuous with an upper end portion of the exhaust-side tappet 47, an intake-side rocker arm 51 swingably supported by a rocker shaft 50 having an axis parallel to the crank shaft 19 and provided in the cylinder head 14, and an exhaust-side rocker arm (not illustrated) swingably supported by the rocker shaft 50. One end portion of the intake-side rocker arm 51 is in contact with an upper end of the intake-side pushrod 48, and one end portion of the exhaust-side rocker arm is in contact with an upper end of the exhaust-side push rod. Tappet screws 53 . . . in contact with head portions of the intake valve 37 and the exhaust valve 38 are screwed to the other end portions of the intake-side rocker arm 51 and the exhaust-side rocker arm, respectively, to allow adjustment of advance/retreat positions.

Opposite end portions of the camshaft 43A are rotatably supported by the case main body 16 and the side cover 17 in the crank case 13. A timing power transmission mechanism 57 formed of a drive gear 55 fixed to the crank shaft 19 and of a driven gear 56 fixed to the camshaft 43A to be in mesh with the drive gear 55 is provided between the camshaft 43A and the crank shaft 19. The timing power transmission mechanism 57 transmits a rotation power of the crank shaft 19 to the camshaft 43A with a reduction ratio of ½.

An exhaust-side cam 58 is integrally provided to the camshaft 43A in a way that a lower end portion of the exhaust-side tappet 47 is in sliding contact with the exhaust-side cam 58. Moreover, an intake-side low-speed cam 59 is integrally provided to the camshaft 43*a*, and an intake-side high-speed cam 60 is supported on the camshaft 43A to be rotatable relative thereto at a position adjacent to the intake-side low-speed cam 59. The intake-side tappet 46 being a cam follower member is supported by the case main body 16 of the crank case 12 and the cylinder block 13 in the engine main body 11 to be contactable with the intake-side low-speed cam 59 and the intake-side high-speed cam 60 and to be operable in a manner following one of the intake-side low-speed cam 59 and the intake-side high-speed cam 60.

The intake-side low-speed cam 59 is integrally provided to the camshaft 43A, and includes an arc-shaped base circle portion 59*a* centered on an axis of the camshaft 43A and a high-level portion 59*b* protruding outward from the base circle portion 59*a*. The intake-side high-speed cam 60 includes a base circle portion 60*a* having the same radius as that of the base circle portion 59*a* of the low-speed cam 59 and also includes a high-level portion 60*b* protruding from the base circle portion 60*a* with a protruding amount thereof being larger than that of the high-level portion 59*b* of the low-speed cam 59.

A centrifugal clutch 61A is provided coaxially with the camshaft 43A between the intake-side high-speed cam 60 and the camshaft 43A integrally provided with the intake-side low-speed cam 59. The centrifugal clutch 61A connects the intake-side high-speed cam 60 to the camshaft 43A while synchronizing the phase of the intake-side high-speed cam 60 with that of the intake-side low-speed cam 59 when the rotation speed of the camshaft 43A reaches or exceeds a predetermined rotation speed.

Figure 2:
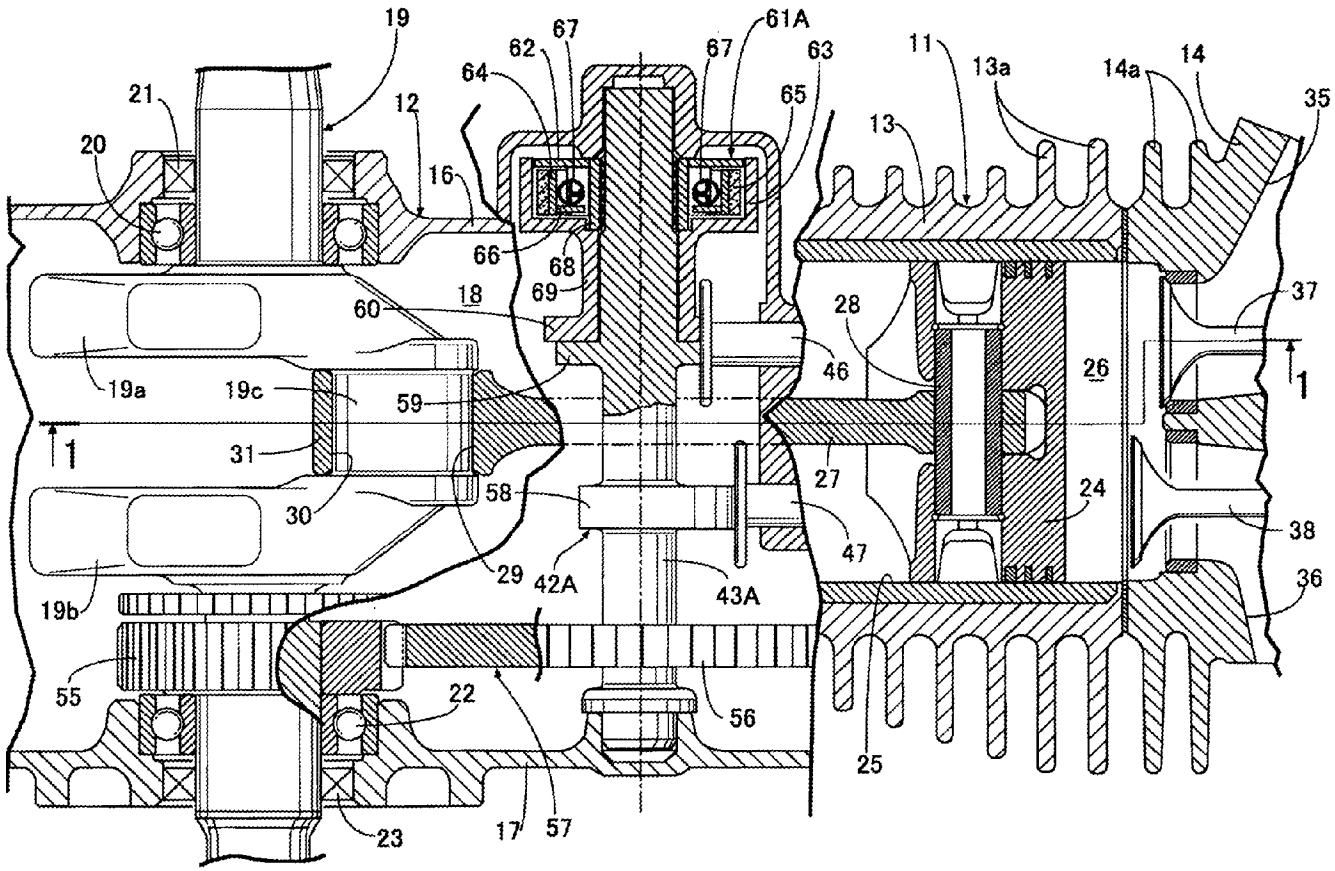
FIG. 2 is an enlarged sectional view taken along a line 2-2 in FIG. 1. (First embodiment)
Figure 3:
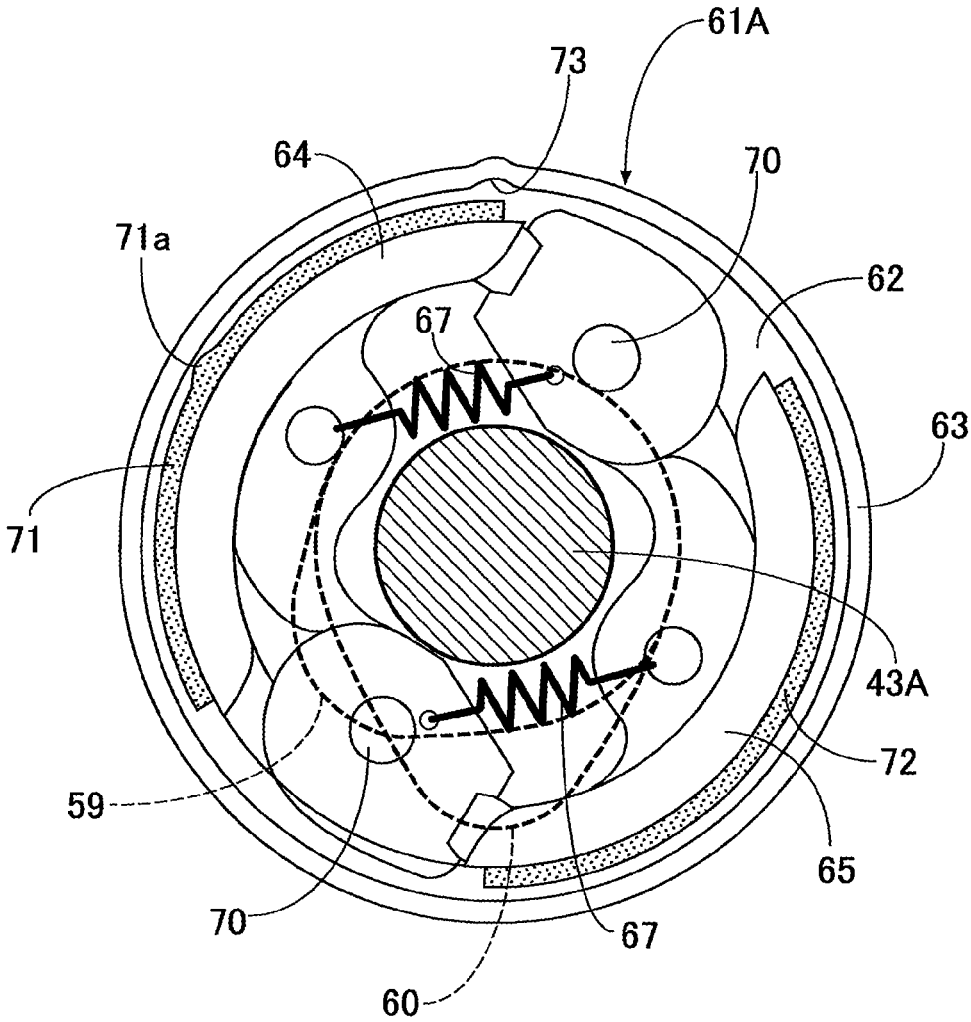
FIG. 3 is a cross-sectional view of a centrifugal clutch in a power transmission block state. (First embodiment)

Referring to FIG. 3, the centrifugal clutch 61A includes a disk-shaped drive plate 62, a bowl-shaped clutch housing 63, clutch weights 64, 65, a ring-shaped side plate 66 (see FIG. 2), and clutch springs 67, 67. The clutch housing 63 coaxially covers the drive plate 62. The clutch weights 64, 65 are rotatably pivotally supported by the drive plate 62 to be frictionally engageable with multiple portions, for example, two portions of an inner periphery of the clutch housing 63 with equal intervals therebetween in a peripheral direction thereof, in accordance with an effect of a centrifugal force generated by the rotation of the drive plate 62. The clutch weights 64, 65 are interposed between the drive plate 62 and the side plate 66. The clutch springs 67, 67 are provided between the clutch weights 64, 65 adjacent to each other in the peripheral direction of the clutch housing 63 to exhibit spring forces biasing the clutch weights 64, 65 in such a direction as to release the friction engagements of the clutch weights 64, 65 with the inner periphery of the clutch housing 63.

As shown in FIG. 2, a cylindrical tube member 68 coaxially surrounding the camshaft 43A is fixed to the camshaft 43A, and the drive plate 62 is fixed to the tube member 68. Moreover, one end of a cylindrical connection tube 69 coaxially surrounding the camshaft 43A is coaxially and integrally continuous with the intake-side high-speed cam 60, and the clutch housing 63 is coaxially and integrally continuous with the other end of the connection tube 69. In other words, the drive plate 62 rotates together with the camshaft 43A, and the clutch housing 63 rotates together with the intake-side high-speed cam 60.

One end portions of the clutch weights 64, 65 are rotatably pivotally supported by the drive plate 62 via pivots 70, 70, respectively. Friction materials 71, 72 frictionally engageable with the inner periphery of the clutch housing 63 are attached to the clutch weights 64, 65, respectively. Moreover, a locking recess portion 73 is provided in one portion of the inner periphery of the clutch housing 63, and an engagement protruding portion 71*a* engageable with the locking recess portion 73 is provided in the friction material 71 of one clutch weight 64 of the clutch weights 64, 65 in a protruding manner.

Figure 4:
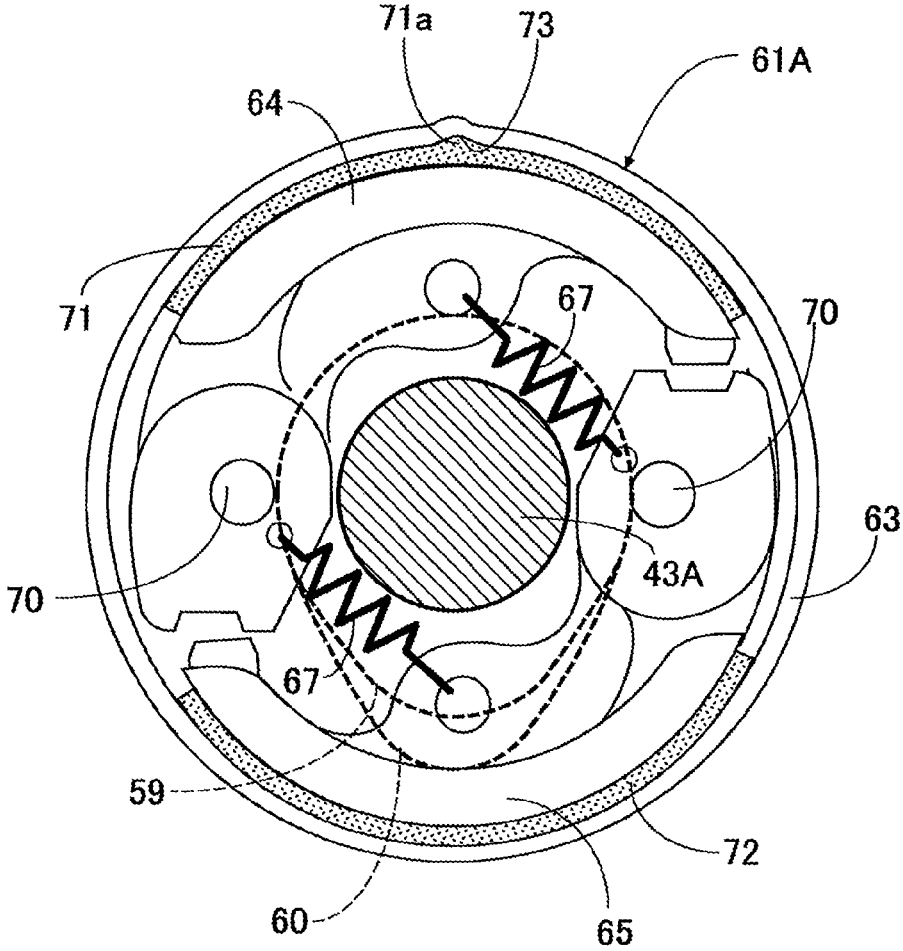
FIG. 4 is a sectional view of the centrifugal clutch in a power transmission state which corresponds to FIG. 3. (First embodiment)

In the centrifugal clutch 61A as described above, when the rotation speed of the camshaft 43A is low, the centrifugal force acting on the clutch weights 64, 65 are smaller than the spring forces of the clutch springs 67 . . . , and, as shown in FIG. 3, rotation positions of the clutch weights 64, 65 are not such positions that the friction materials 71, 72 are frictionally engaged with the inner periphery of the clutch housing 63. When the rotation speed of the camshaft 43A reaches or exceeds the predetermined rotation speed, the centrifugal force acting on the clutch weights 64, 65 becomes larger than the spring forces of the clutch springs 67 . . . , and the clutch weights 64, 65 rotate to such positions that the friction materials 71, 72 are frictionally engaged with the inner periphery of the clutch housing 63. In this configuration, the engagement protruding portion 71*a* is provided in the friction material 71 of the clutch weight 64 in a protruding manner. When the engagement protruding portion 71*a* is in contact with the inner periphery of the clutch housing 63, the entire surfaces of the friction materials 71, 72 are not in contact with the inner periphery of the clutch housing 63. Thus, the drive plate 62 rotates relative to the clutch housing 63, and, as shown in FIG. 4, the engagement protruding portion 71*a* engages with the locking recess portion 73 of the clutch housing 63. Hence, the entire surfaces of the friction materials 71, 72 are brought into pressure contact with and frictionally engaged with the inner periphery of the clutch housing 63. This causes the drive plate 62, i.e. the camshaft 43A, and the clutch housing 63, i.e. the intake-side high-speed cam 60, to be connected to each other and to rotate integrally.

Moreover, when the engagement protruding portion 71*a* is engaged with the locking recess portion 73, the position of the camshaft 43A and the position of the connection tube 69 relative to each other, i.e. the position of the intake-side low-speed cam 59 integrally provided to the camshaft 43A and the position of the intake-side high-speed cam 60 joined to the connection tube 69 relative to each other are relative positions that cause the phase of the high-level portion 59*b* of the intake-side low-speed cam 59 and the phase of the high-level portion 60*b* of the intake-side high-speed cam 60 to be synchronized with each other.

Next, an operation of the first embodiment is described. The intake-side low-speed cam 59 is fixedly provided in the camshaft 43A. In addition, the intake-side high-speed cam 60 is supported on the camshaft 43A to be rotatable relative thereto at a position adjacent to the intake-side low-speed cam 59, the intake-side high-speed cam 60 including the base circle portion 60*a* having the same radius as that of the base circle portion 59*a* of the intake-side low-speed cam 59 and also including the high-level portion 60*b* whose protruding amount is larger than that of the high-level portion 59*b* of the intake-side low-speed cam 59. The intake-side tappet 46 is supported by the case main body 16 of the crank case 12 and the cylinder block 13 in the engine main body 11 to be contactable with both of the intake-side low-speed cam 59 and the intake-side high-speed cam 60 and to be operable in a manner following one of the intake-side low-speed cam 59 and the intake-side high-speed cam 60. The centrifugal clutch 61A is provided coaxially with the camshaft 43A between the camshaft 43A and the intake-side high-speed cam 60, the centrifugal clutch 61A configured to connect the intake-side high-speed cam 60 to the camshaft 43A while synchronizing the phase of the intake-side high-speed cam 60 with that of the intake-side low-speed cam 59 when the rotation speed of the camshaft 43A reaches or exceeds the predetermined rotation speed.

Figure 5:
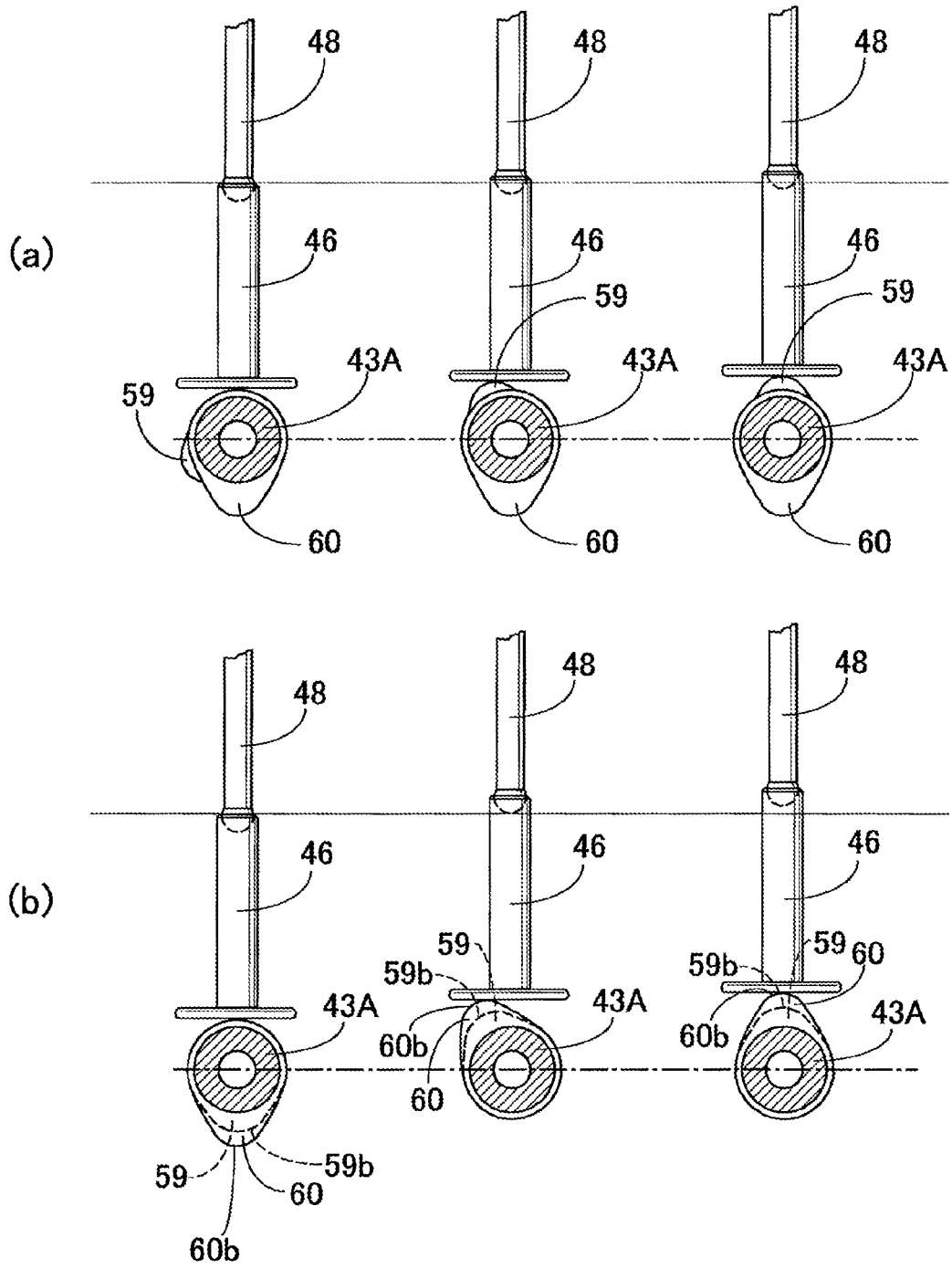
FIG. 5 is a view sequentially showing operation states of an intake-side tappet which correspond to a rotation of a camshaft, (a) is a view showing a state in low-speed rotation, and (b) is a view showing a state in high-speed rotation. (First embodiment)

Accordingly, when the rotation speed of the camshaft 43A is below the predetermined rotation speed, the centrifugal clutch 61A is in a power transmission block state. As shown in FIG. 5(*a*), in this state, the intake-side low-speed cam 59 rotates together with the camshaft 43A while the intake-side high-speed cam 60 rotates in an idling manner about the axis of the camshaft 43A. Thus, the intake valve 37 is operated to be opened and closed with operation characteristics in accordance with a cam profile of the intake-side low-speed cam 59.

Meanwhile, when the rotation speed of the camshaft 43A reaches or exceeds the predetermined rotation speed, the centrifugal clutch 61A connects the intake-side high-speed cam 60 to the camshaft 43A while synchronizing the phase of the intake-side high-speed cam 60 with that of the intake-side low-speed cam 59. As shown in FIG. 5(*b*), in this state, the intake-side low-speed cam 59 and the intake-side high-speed cam 60 rotate in the same phase. Since the high-level portion 60*b* of the intake-side high-speed cam 60 has a larger protruding amount than the high-level portion 59*b* of the intake-side low-speed cam 59, the intake-side tappet 46 does not come into contact with the high-level portion 59*b* of the intake-side low-speed cam 59, and operates in a manner following the high-level portion 60*b* of the intake-side high-speed cam 60. Thus, the intake valve 37 is operated to be opened and closed with operation characteristics according to a cam profile of the intake-side high-speed cam 60.

Moreover, the centrifugal clutch 61A for switching the operation characteristics of the intake valve 37 is provided coaxially with the camshaft 43A between the camshaft 43A and the intake-side high-speed cam 60. Thus, the operation characteristics of the intake valve 37 can be changed with a simple and compact structure.

Second Embodiment

Figure 6:
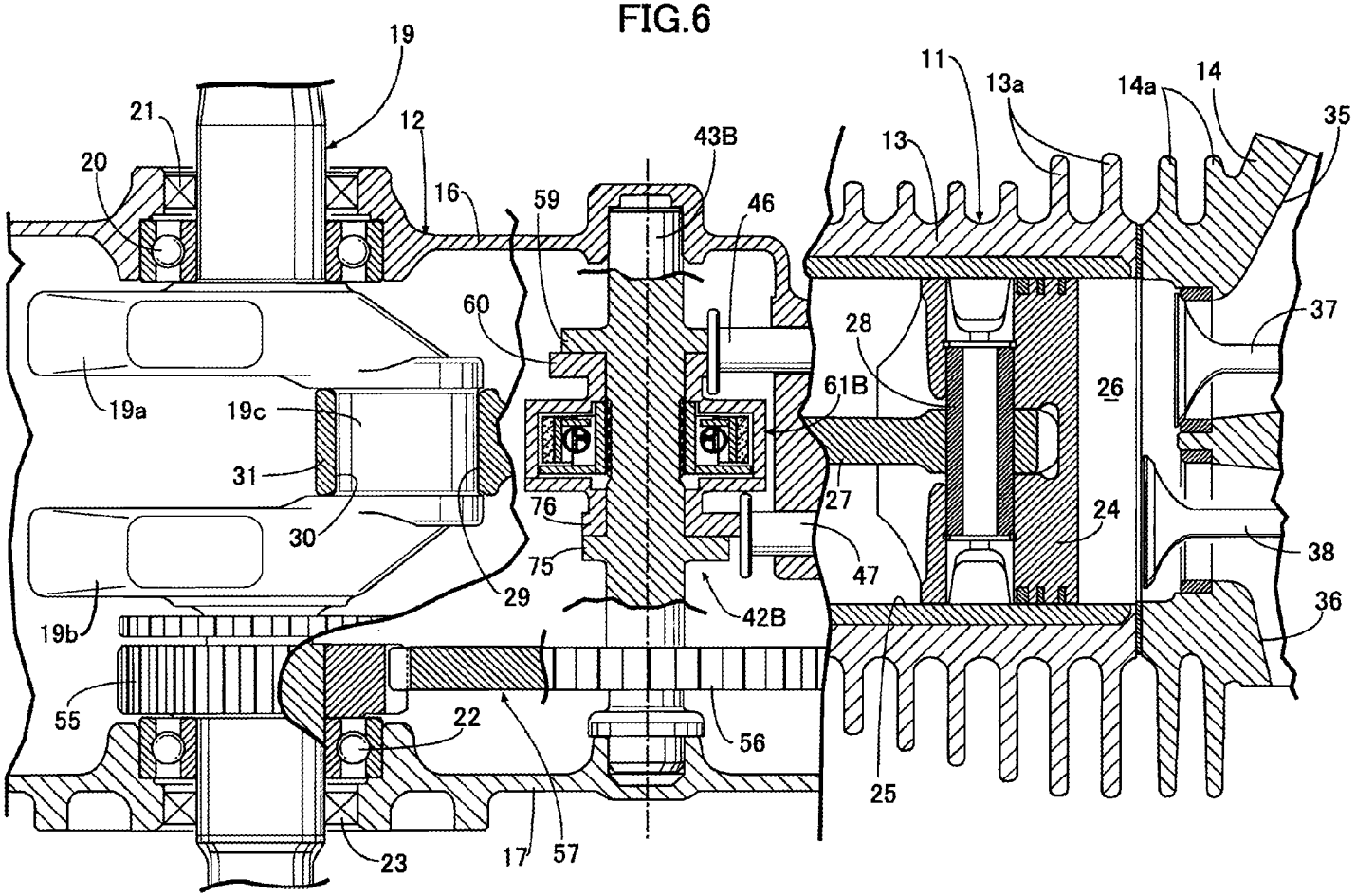
FIG. 6 is a sectional view of an internal combustion engine of a second embodiment which corresponds to FIG. 2. (Second embodiment)

In the first embodiment described above, descriptions are given of the case where only the operation characteristics of the intake valve 37 among the intake valve 37 and the exhaust valve 38 are changed in accordance with the rotation speed change of the camshaft 43A. Referring to FIG. 6, description is given of a second embodiment of the present invention in which the operation characteristics of both of the intake valve 37 and the exhaust valve 38 are changed. Note that, portions of the second embodiment which correspond to those of the first embodiment are illustrated by being denoted by the same reference numerals, and detailed descriptions thereof are omitted.

A valve operating device 42B driving an intake valve 37 and an exhaust valve 38 being engine valves to open and close includes a camshaft 43B, an intake-side tappet 46, and an exhaust-side tappet 47. The camshaft 43B is rotatably supported by a crank case 12, and a timing power transmission mechanism 57 is provided between the camshaft 43B and the crank shaft 19. The intake-side tappet 46 is supported by a case main body 16 of the crank case 12 and a cylinder block 13 to slide in an up-down direction in accordance with the rotation of the camshaft 43B. The exhaust-side tappet 47 is supported by the case main body 16 and the cylinder block 13 to slide in the up-down direction in accordance with the rotation of the camshaft 43B.

Moreover, an intake-side low-speed cam 59 and an exhaust-side low-speed cam 75 are integrally provided to the camshaft 43B. An intake-side high-speed cam 60 and an exhaust-side high-speed cam 76 are supported on the camshaft 43B to be rotatable relative thereto at positions adjacent to the intake-side low-speed cam 59 and the exhaust-side low-speed cam 75, respectively. Specifically, the intake-side high-speed cam 60 is disposed at a position adjacent to the intake-side low-speed cam 59 on a side closer to the exhaust-side low-speed cam 75, and the exhaust-side high-speed cam 76 is disposed at a position adjacent to the exhaust-side low-speed cam 75 on a side closer to the intake-side low-speed cam 59.

The intake-side tappet 46 being a cam follower member is supported by the case main body 16 of the crank case 12 and the cylinder block 13 in an engine main body 11 to be contactable with both of the intake-side low-speed cam 59 and the intake-side high-speed cam 60 and to be operable in a manner following one of the intake-side low-speed cam 59 and the intake-side high-speed cam 60. The exhaust-side tappet 47 being a cam follower member is supported by the case main body 16 of the crank case 12 and the cylinder block 13 in the engine main body 11 to be contactable with both of the exhaust-side low-speed cam 75 and the exhaust-side high-speed cam 76 and to be operable in a manner following one of the exhaust-side low-speed cam 75 and the exhaust-side high-speed cam 76.

A centrifugal clutch 61B is provided coaxially with the camshaft 43B between the camshaft 43B integrally provided with the intake-side low-speed cam 59 and the exhaust-side low-speed cam 75 and a group of the intake-side high-speed cam 60 and the exhaust-side high-speed cam 76, the centrifugal clutch 61B connecting the intake-side high-speed cam 60 and the exhaust-side high-speed cam 76 to the camshaft 43B while synchronizing the phases of the intake-side high-speed cam 60 and the exhaust-side high-speed cam 76 respectively to those of the intake-side low-speed cam 59 and the exhaust-side low-speed cam 75 when the rotation speed of the camshaft 43B reaches or exceeds a predetermined rotation speed.

According to the second embodiment, when the rotation speed of the camshaft 43B is below the predetermined rotation speed, the centrifugal clutch 61B is in a power transmission block state. The intake-side low-speed cam 59 and the exhaust-side low-speed cam 75 rotate together with the camshaft 43B while the intake-side high-speed cam 60 and the exhaust-side high-speed cam 76 rotate in an idling manner about the axis of the camshaft 43B. Thus, the intake valve 37 is operated to be opened and closed with operation characteristics according to a cam profile of the intake-side low-speed cam 59, and the exhaust valve 38 is operated to be opened and closed with operation characteristics according to a cam profile of the exhaust-side low-speed cam 75.

Meanwhile, when the rotation speed of the camshaft 43B reaches or exceeds the predetermined rotation speed, the centrifugal clutch 61B connects the intake-side high-speed cam 60 to the camshaft 43B while synchronizing the phase of the intake-side high-speed cam 60 with that of the intake-side low-speed cam 59, and connects the exhaust-side high-speed cam 76 to the camshaft 43B while synchronizing the phase of the exhaust-side high-speed cam 76 to that of the exhaust-side low-speed cam 75. Thus, the intake valve 37 is operated to be opened and closed with operation characteristics according to a cam profile of the intake-side high-speed cam 60, and the exhaust valve 38 is operated to be opened and closed with operation characteristics according to a cam profile of the exhaust-side high-speed cam 76.

Moreover, the centrifugal clutch 61B for switching the operation characteristics of the intake valve 37 and the exhaust valve 38 is provided coaxially with the camshaft 43B between the camshaft 43B and a group of the intake-side high-speed cam 60 and the exhaust-side high-speed cam 76. Thus, the operation characteristics of the intake valve 37 and the exhaust valve 38 can be changed with a simple and compact structure.

Embodiments of the present invention are explained above, but the present invention is not limited to the above-mentioned embodiments and may be modified in a variety of ways as long as the modifications do not depart from the gist of the present invention.

The invention claimed is:

1. A variable valve operating device for an internal combustion engine, including: an engine valve which is disposed in an engine main body to be operable to be opened and closed and which is biased to a valve-closing side; a camshaft rotatably supported by the engine main body; and a cam follower member which follows a cam rotating together with the camshaft and operates to transmit a valve-opening force to the engine valve side, the variable valve operating device being capable of changing an operation characteristic of the engine valve in accordance with a change in rotation speed of the camshaft, wherein a high-speed cam is supported on the camshaft having a low-speed cam fixed thereto such that the high-speed cam is rotatable relative to the camshaft, at a position adjacent to the low-speed cam, the low-speed cam including an arc-shaped base circle portion which is centered on an axis of the camshaft and a high-level portion which protrudes outward from the base circle portion, the high-speed cam including a base circle portion which has the same radius as that of the base circle portion of the low-speed cam and also including a high-level portion which has a protruding amount larger than that of the high-level portion of the low-speed cam, the cam follower member contactable with the low-speed cam and the high-speed cam is supported by the engine main body to be operable in a manner following one of the low-speed cam and the high-speed cam, and a centrifugal clutch is provided coaxially with the camshaft, between the camshaft and the high-speed cam, the centrifugal clutch configured to connect the high-speed cam to the camshaft while synchronizing a phase of the high-speed cam with that of the low-speed cam when a rotation speed of the camshaft reaches or exceeds a predetermined rotation speed the centrifugal clutch comprises a drive plate integrally rotatable with the camshaft, a bowl-shaped clutch housing arranged coaxially with the camshaft and integrally rotatable with the high-speed cam, a clutch weight housed in the clutch housing and rotatably pivotally supported on the drive plate, a friction material of an arcuate shape mounted on the clutch weight so as to engage frictionally with an inner surface of an outer peripheral wall of the clutch housing in response to the clutch weight rotating with a centrifugal force acting on the clutch weight, and a clutch spring normally urging the clutch weight to release frictional engagement of the friction material with the clutch housing, a locking recess portion and an engagement protruding portion which is engageable with the locking recess portion are provided on mutually opposed surfaces of the outer peripheral wall of the clutch housing and the friction material, and engagement between the locking recess portion and the engagement protruding portion defines a connected position of the high-speed cam with the camshaft in a rotational direction.

* * * * *